US006099893A

United States Patent [19]

Lee et al.

[11] Patent Number: 6,099,893

[45] Date of Patent: Aug. 8, 2000

[54] METHOD OF FABRICATING A FLUORESCENT LAYER FOR A DISPLAY DEVICE

[75] Inventors: Si-hyun Lee; Joo-sang Park, both of Suwon, Rep. of Korea

[73] Assignee: Samsung Display Devices Co., Ltd., Kyungki-Do, Rep. of Korea

[21] Appl. No.: 09/083,275

[22] Filed: May 22, 1998

[51] Int. Cl.[7] ..... D05D 5/06

[52] U.S. Cl. ..... 427/64; 427/162; 427/165; 427/387; 427/596

[58] Field of Search ..... 427/596, 564, 427/566, 64, 68, 287, 162, 165, 286

[56] References Cited

U.S. PATENT DOCUMENTS 3,978,247 8/1976 Braudy .
4,752,455 6/1988 Mayer .
4,895,735 1/1990 Cook .
4,970,196 11/1990 Kim et al. ..... 505/1

*Primary Examiner*—Janyce Bell
*Attorney, Agent, or Firm*—Lowe Hauptman Gopstein Gilman & Berner

[57] ABSTRACT

A method of manufacturing a fluorescent layer having a striped or dot pattern for a display device, including the steps of installing a donor film composed of a base film, a light absorbing layer, a buffering layer and a phosphor layer being departed from a substrate by predetermined distance, and irradiating an energy source to the donor film to transfer a phosphor from the phosphor layer to the surface of the substrate and then thermally treating the transferred phosphor. In the method, defects generated by dust or foreign substances are reduced so that manufacturing yield is improved compared to the conventional method. Also, the process is simple so that productivity is enhanced and a high resolution screen is realized.

3 Claims, 3 Drawing Sheets

METHOD OF FABRICATING A FLUORESCENT LAYER FOR A DISPLAY DEVICE

BACKGROUND OF THE INVENTION

The present invention relates to a display device, and more particularly, to a method of manufacturing a fluorescent layer for a display device.

An image display device which is used for displaying information on a display screen includes a cathode ray tube (CRT) employing the emission of thermal electrons and the light emission of phosphors, a vaccums fluorescent display (VFD) having a principle similar to that of the CRT and whose entire shape is usually flat, a liquid crystal display (LCD) using an electro-optical characteristics of liquid crystals, a plasma display panel (PDP) using a gaseous discharge phenomenon between charged electrodes, and others.

The display devices employ a fluorescent layer of red, green and blue phosphors or a color filter layer for color display.

The fluorescent layer for color display is formed using, for example, a photolithography process or a printing process. However, the photolithography process includes a phosphor composition coating process and exposure, developing and thermal treatment processes which are repeatedly performed, so that it is very long and complicated and, particularly, defects are frequently generated by dust during the exposure and developing processes. Also, before the phosphor composition is coated, an undercoating solution must be coated and thermally treated in order to enhance the adhesion strength of the composition.

Meanwhile, according to the printing method which is usually used in a flat display such as a plasma display panel (PDP) or a field emission display (FED), a uniform phosphor film pattern can be obtained. However, the printing method has the following problems.

First, the thickness of the phosphor pattern formed by this method is inconsistent (the deviation in thickness is about 20%).

Second, since the printing method is based on a screen printing, the resolution is limited to about 80pm so that it is difficult to form a high-resolution phosphor pattern.

SUMMARY OF THE INVENTION

It is an object of the present invention to provide a method of manufacturing a fluorescent layer for a display device whereby defects caused by dust or foreign substances are reduced and the resolution of the fluorescent layer is improved.

To accomplish the object, there is provided a method of manufacturing a fluorescent layer having a striped or dot pattern for a display device, comprising the steps of: (a) installing a donor film on a substrate, the donor film having a base film, a light absorbing layer, a buffering layer and a phosphor layer spaced from the substrate by predetermined distance; and (b) irradiating an energy source to the donor film to transfer a phosphor from the phosphor layer to the surface of the substrate and then thermally treating the transferred phosphor.

The base film functions as a supporter, and it is preferable that the base film has an optical transmissivity of 90% or more. Examples of the base film are polyethylene terephthalate and polycarbonate film.

The light absorbing layer absorbs light or heat converted from the light, to be decomposed, and emits a nitrogen gas or a hydrogen gas, thereby providing a transfer energy. This layer is formed from the group consisting of at least one of aluminum (Al), bismuth (Bi), tin (Sn), indium (In), zinc (Zn), titanium (Ti), chrome (Cr), molybdenum (Mo), tungsten (W), cobalt (Co), iridium (Ir), nickel (Ni), palladium (Pd), platinum (Pt), copper (Cu), silver (Ag), gold (Au), zirconium (Zr), iron (Fe), oxides and sulfides thereof, dyes and pigments. The buffering layer functions to transmit the heat of the light absorbing layer to the phosphor layer and is formed of a material selected from pentaerythritol tetranitrate (PETN) and trinitrotoluene (TNT).

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

In the present invention, a fluorescent layer is formed using a laser transfer method. Here, the laser transfer method is widely used in the fields of printing, typesetting, photography and the like. This method utilizes a principle in which an object material is transferred to a receptor by propelling the object material to be transferred to the receptor.

Figure 1:
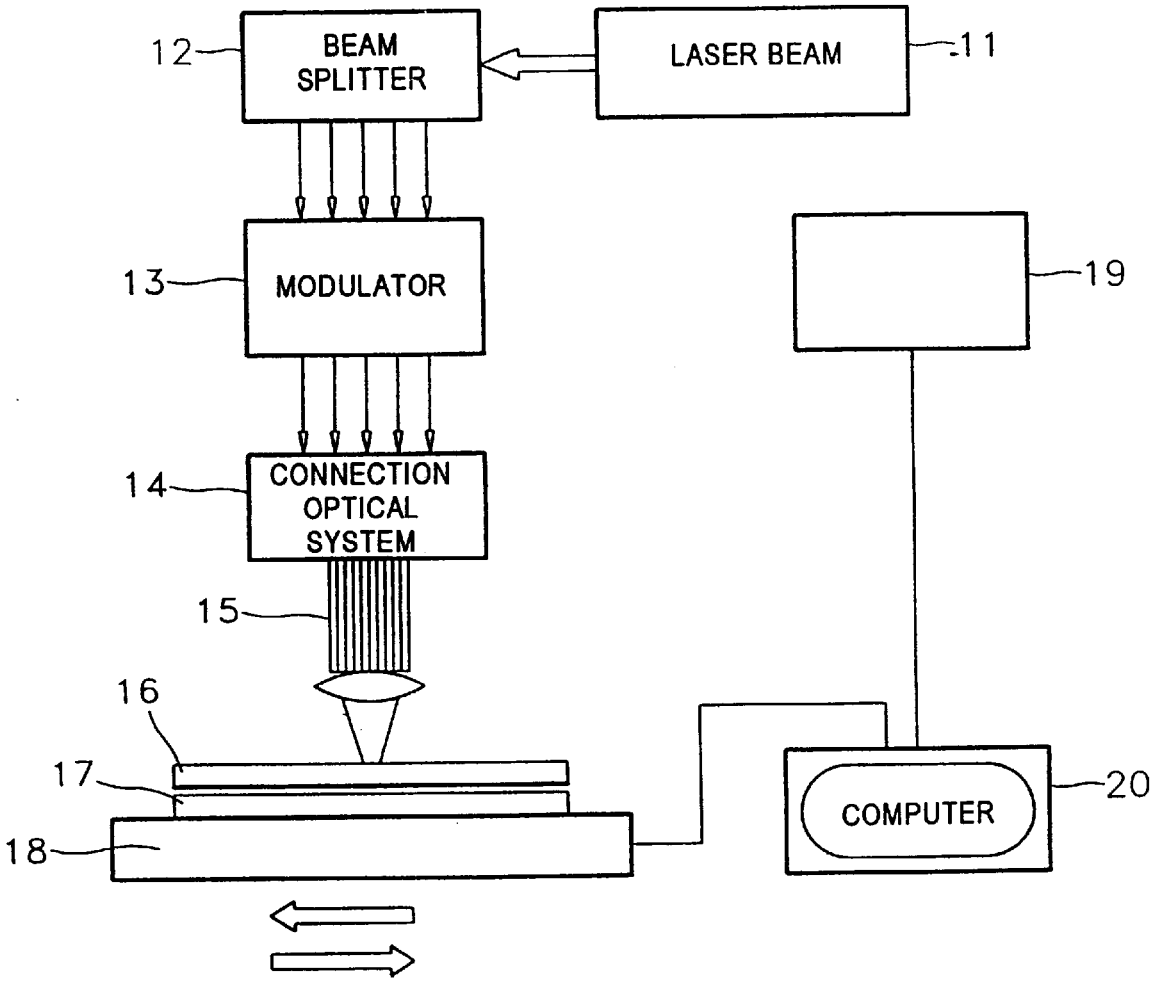
FIG. 1 is a schematic diagram of a laser transferring device used in the present invention.

FIG. 1 is a schematic diagram of a laser transfer device which is used in the present invention.

Referring to FIG. 1, a high power laser beam 11 is emitted from an energy source. The energy source includes a high power solid laser such as Nd/YAG, a gas laser such as $CO_2$ or CO and a diode-coupled Nd/YAG. The emitted laser beam passes through a beam splitter 12 and is split into several beams having the same intensity.

The laser beam split into several beams is controlled in its intensity ratio by a modulator 13 according to a shape of the transferred substance, passes through an optical fiber 15 via a connection optical system 14, and is then irradiated to the surface of a donor film 16 including a phosphor layer. At this time, only a phosphor coated on a portion, having received light, of the donor film 16 is transcribed on a receiving body 17. At this time, the motion of a stage 18 is controlled by a computer 20 and a raiter 19 for controlling the intensity of a bunch of beams according to the shape of the transferred substance.

Figure 2:
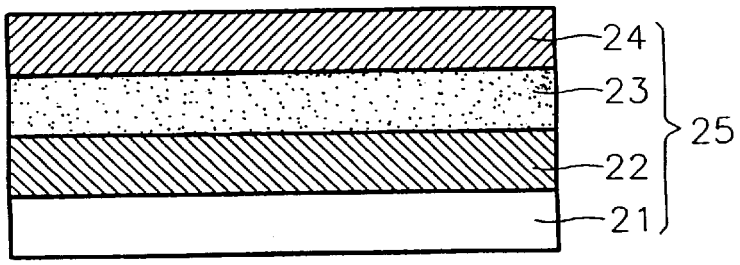
FIG. 2 is a sectional view of the structure of a donor film according to the present invention.

FIG. 2 shows the structure of a donor film 25 which is used in the present invention.

Referring to FIG. 2, a light absorbing layer 22, a buffering layer 23 and a phosphor layer 24 are sequentially formed on a base film 21.

Figure 3A:
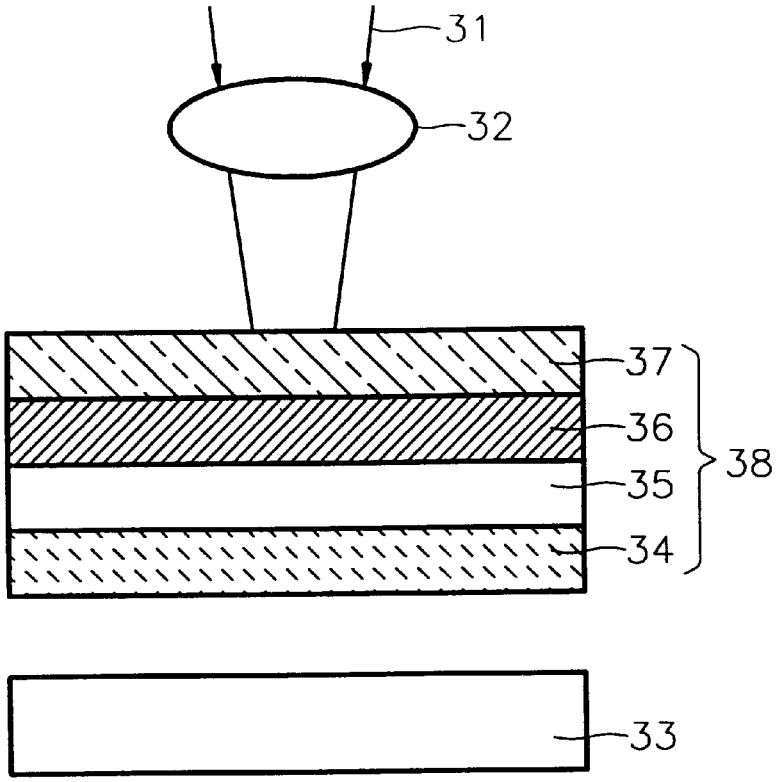
FIGS. 3A, 3B and 3C are sectional views for illustrating procedures for manufacturing a fluorescent layer according to the present invention.
Figure 3B:
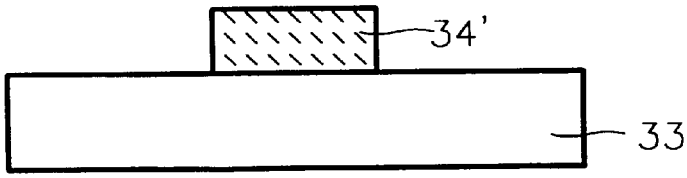
Figure 3C:
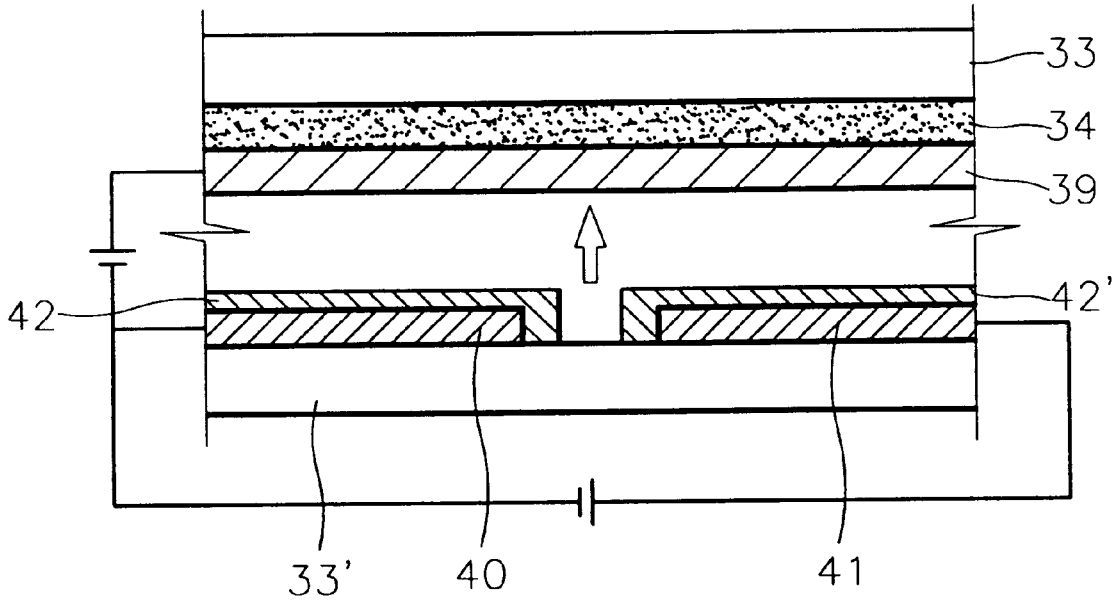

FIGS. 3A, 3B and 3C are sectional views for illustrating the step of transferring a phosphor layer pattern, in a method of manufacturing a fluorescent layer for a field emission display (FED) according to an embodiment of the present invention.

A light absorbing layer 36, a buffering layer 35 and a phosphor layer 34 are sequentially coated on a base film 37, thereby forming a donor film 38.

Then, the donor film 38 is disposed on a first substrate 33. Next, an energy source is irradiated to the donor film 38 disposed above. A laser beam, a xenon lamp or a halogen lamp can be used as the energy source. An energy source selected among them passes through a transfer device 32 and the base film 37 to activate the light absorbing layer 36 and emit a hydrogen or nitrogen gas generated due to a decomposition reaction simultaneously with heat. The emitted heat is transmitted to the buffering layer 35, and the explosion of the gas causes a phosphor to be transferred to the upper surface of the first substrate 33.

After the transferring process is performed, a thermal treatment is performed to solidify and adhere the transferred phosphor.

Here, the transfer of the phosphor is made through a single step or several steps. That is, the thickness of the phosphor layer is formed by transferring as much as desired at a time or by performing a transferring several times. However, considering the convenience and stability of the process, it is preferable to transfer the phosphor in one step.

FIG. 3B shows the first substrate 33 having a phosphor layer 34' manufactured by the above-described method.

In addition, first electrodes 40 and second electrodes 41 are formed being isolated from each other on a second substrate 33' opposite the first substrate 33. Then, thin film layers 42 and 42' are formed on the first electrodes 40 and second electrodes 41, respectively.

Thereafter, an acceleration electrode layer 39 is formed on the phosphor layer 34' of the first substrate 33. The first substrate 33 is stacked on the second substrate 33', thereby completing a field emission display (FED) of FIG. 3C. The operation principle of the FED having such a structure is as follows.

As a predetermined voltage is applied to the first electrodes 40 and second electrodes 41, an electron emitted between the thin film layers 42 and 42' coated on the respective electrodes is accelerated to the acceleration electrode layer 39 so that the phosphor layer 34' emits light.

The present invention has the following effects.

First, the process using a dry-etching method reduces defects generated by dust or foreign substances, so that compared to the conventional method, manufacturing yield is improved by about 10% or more. Also, the simple process increases productivity.

Second, in the case of the conventional methods, resolution is substantially between 70 and 100 $\mu$m, but according to the present invention, the resolution of up to 20 $\mu$m can be obtained. Thus, a high resolution pattern is formed.

What is claimed is:

1. A method of manufacturing a fluorescent layer having a striped or dot pattern for a display device, comprising the steps of:

(a) installing a donor film on a substrate, said donor film having a base film, a light absorbing layer, a buffering layer and a phosphor layer spaced from the substrate by a predetermined distance; and (b) irradiating an energy source to the donor film to transfer a phosphor from the phosphor layer to a surface of the substrate and then thermally treating the transferred phosphor.

2. The method of claim 1, wherein said energy source is selected from the group consisting of a laser beam, a xenon lamp and a halogen lamp.

3. A method of manufacturing a fluorescent layer having a striped or dot pattern for a display device, comprising the steps of:

(a) forming a donor film by sequentially coating a light absorbing layer, a buffering layer and a phosphor layer on a base film;

(b) disposing the donor film on a substrate so that the phosphor layer is spaced from a surface of the substrate; and (c) irradiating an energy source onto the donor film to transfer a phosphor form the phosphor layer to the surface of the substrate and then thermally treating the transferred layer.

* * * * *